US011691844B2

(12) United States Patent
Zajkowski et al.

(10) Patent No.: US 11,691,844 B2
(45) Date of Patent: Jul. 4, 2023

(54) CABLE TENSIONING SYSTEMS

(71) Applicants: General Electric Company, Schenectady, NY (US); Oliver Crispin Robotics Limited, Altrincham (GB)

(72) Inventors: Mark John Zajkowski, Austerlitz, NY (US); Huseyin Kandir, Schenectady, NY (US); Todd William Danko, Niskayuna, NY (US); Don Mark Lipkin, Niskayuna, NY (US); Wayne Ray Grady, Hamilton, OH (US); Andrew Crispin Graham, Badminton (GB); Trevor Owen Hawke, Bristol (GB)

(73) Assignees: General Electric Company, Schenectady, NY (US); Oliver Crispin Robotics Limited, Altrincham (GB)

( * ) Notice: Subject to any disclaimer, the term of this patent is extended or adjusted under 35 U.S.C. 154(b) by 42 days.

(21) Appl. No.: 17/148,990

(22) Filed: Jan. 14, 2021

(65) Prior Publication Data

US 2022/0219937 A1 Jul. 14, 2022

(51) Int. Cl.

| | |
|---|---|
| ***B65H 59/40*** | (2006.01) |
| ***B65H 59/18*** | (2006.01) |
| ***B65H 59/28*** | (2006.01) |
| ***B65H 59/38*** | (2006.01) |
| ***B65H 59/34*** | (2006.01) |

(52) U.S. Cl.

CPC ..... *B65H 59/40* (2013.01); *B65H 59/18* (2013.01); *B65H 59/28* (2013.01); *B65H 59/34* (2013.01); *B65H 59/388* (2013.01)

(58) Field of Classification Search

CPC ..... B65H 59/18; B65H 59/28; B65H 59/388; B65H 59/40

See application file for complete search history.

(56) References Cited

U.S. PATENT DOCUMENTS

| | | | |
|---|---|---|---|
| 3,618,897 | A | 11/1971 | Swoboda, Jr. et al. |
| 4,023,744 | A | 5/1977 | Shutt |
| 4,166,596 | A | 9/1979 | Mouton, Jr. et al. |
| 4,359,207 | A | 11/1982 | Maryonovich et al. |
| 5,009,353 | A | 4/1991 | Alquist |

(Continued)

FOREIGN PATENT DOCUMENTS

| | | |
|---|---|---|
| CN | 101393787 | 3/2009 |
| CN | 110217630 | 9/2019 |

(Continued)

OTHER PUBLICATIONS

Machine Translation of KR-2011-0006373 A, Jan. 20, 2011. (Year: 2011).*

(Continued)

*Primary Examiner* — William E Dondero

(74) *Attorney, Agent, or Firm* — Fitch, Even, Tabin & Flannery, LLP

(57) ABSTRACT

A cable tensioning system including: a body defining a balance point; a cable receiving area having gripping elements configured to grip and bias a cable relative to the cable tensioning system; and a sensor configured to sense changes to a balance of the body about the balance point, wherein the cable tensioning system is configured to maintain the cable within a preset range of tensions.

15 Claims, 5 Drawing Sheets

(56) References Cited

U.S. PATENT DOCUMENTS

| | | | |
|---|---|---|---|
| 5,295,664 | A | 3/1994 | Kamper |
| 6,866,250 | B2 | 3/2005 | Kita |
| 7,562,862 | B1 | 7/2009 | Jackson |
| 10,427,734 | B2 | 10/2019 | Akin et al. |
| 10,569,415 | B2 | 2/2020 | Doggett et al. |
| 11,103,964 | B2 | 8/2021 | Lipkin |
| 2016/0200437 | A1 | 7/2016 | Ryan et al. |

FOREIGN PATENT DOCUMENTS

| | | |
|---|---|---|
| CN | 210763661 | 6/2020 |
| EP | 0275852 | 7/1988 |
| JP | H01150678 | 6/1989 |
| KR | 20110006373 | 1/2011 |
| WO | WO2016115155 A1 | 7/2016 |

OTHER PUBLICATIONS

Machine Translation of CN 110217630 A. Sep. 10, 2019. (Year: 2019).*

Tether Management: An Overview; ScienceDirect Topics; From: Subsea Engineering Handbook, 2010; https://www.sciencedirect.com/topics/engineering/tether-management; 30 pgs.

Constant Torque Spring Motors: The Ultimate guide, Jun. 2021; https://www.yshspring.com/constant-torque-spring-motors/; 9 pgs.

* cited by examiner

CABLE TENSIONING SYSTEMS

FIELD

The present subject matter relates generally to cable tensioning systems, and more particularly to active cable tension systems.

BACKGROUND

Cables are often used in servicing operations of equipment, such as gas turbine engines. The cables can include, for example, umbilical cables that provide control functions, cameras, lights, and process chemical conduits. As the servicing operation is underway, the cable may be subjected to loading conditions or moved relative to the equipment. It may be important to maintain a specified tension within cables during these operations in order to provide a better service. Additionally, maintaining tension within the cables can reduce the potential for tangling.

Traditionally, tension of the cables has been maintained by hand. That is, an operator pulls on the cable, adding and removing slack therefrom to approximate an equal tension profile. Accordingly, the industry continues to demand improved cable tensioning systems for maintaining tension in any cable distribution system.

BRIEF DESCRIPTION

Aspects and advantages of the invention will be set forth in part in the following description, or may be obvious from the description, or may be learned through practice of the invention.

In one exemplary embodiment of the present disclosure, a cable tensioning system comprising: a body defining a balance point; a cable receiving area having gripping elements configured to grip and bias a cable relative to the cable tensioning system; and a sensor configured to sense changes to a balance of the body about the balance point, wherein the cable tensioning system is configured to maintain the cable within a preset range of tensions.

According to another exemplary embodiment, a cable tensioning system comprising: a body defining a balance point; a plurality of gripping elements configured to grip and bias a cable relative to the cable tensioning system; an adjustable counterweight; a sensor configured to sense changing tension of the cable; a logic element configured to receive the sensed change in tension of the cable and provide corrective instructions to maintain the cable within a preset range of tensions; and a motor coupled to at least one of the gripping elements and configured to rotatably bias the at least one gripping element in response to the corrective instructions from the logic element, wherein the preset range of tensions is adjustable using the adjustable counterweight.

According to another exemplary embodiment, a method of maintaining tension of a cable, the method comprising: inserting the cable into a cable receiving area of a cable tensioning system, the cable receiving area comprising a plurality of gripping elements; sensing changes to a balance of the cable tensioning system about a balance point of the cable tensioning system; and biasing the gripping elements relative to the cable in response to the sensed balance change.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
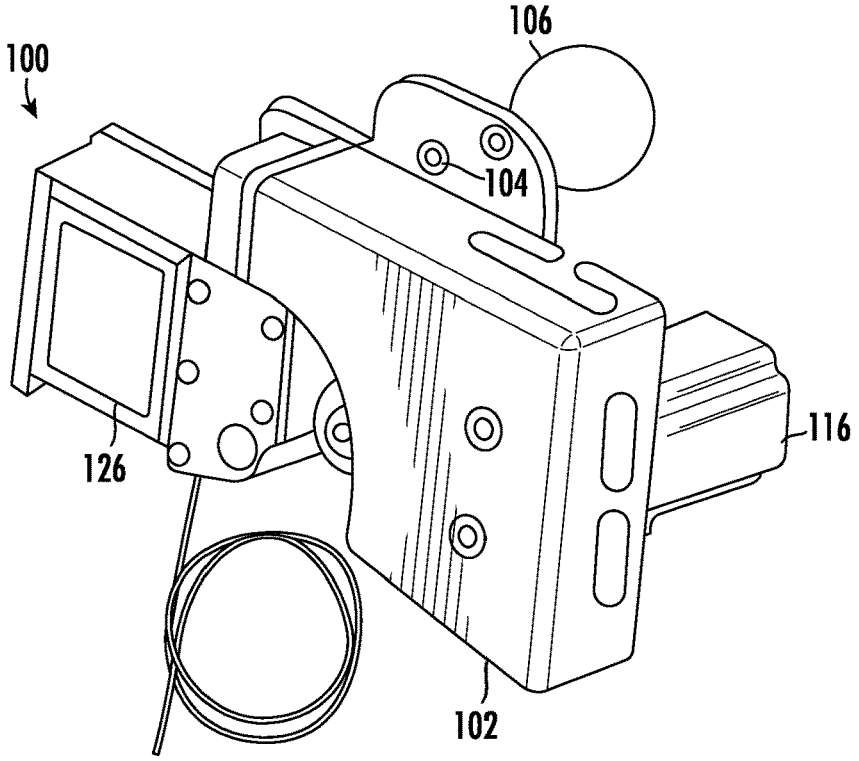
FIG. 1 is a front perspective view of a cable tensioning system in accordance with an exemplary embodiment of the present disclosure.

Repeat use of reference characters in the present specification and drawings is intended to represent the same or analogous features or elements of the present invention.

DETAILED DESCRIPTION

Reference now will be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The word "exemplary" is used herein to mean "serving as an example, instance, or illustration." Any implementation described herein as "exemplary" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine exhaust. The terms "upstream" and "downstream" refer to the relative direction with respect to fluid flow in a fluid pathway. For example, "upstream" refers to the direction from which the fluid flows, and "downstream" refers to the direction to which the fluid flows.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In accordance with one or more embodiments described herein, a cable tensioning system can generally maintain tension of a cable within a desired tolerance. The cable tensioning system can include gripping elements, such as rollers, which engage the cable and bias the cable to maintain a constant, or generally constant, cable tension. As used herein, the term "bias" refers to the application of force along the cable. In an exemplary embodiment, this force can be applied from the cable tensioning system to the cable by rotating the gripping elements so as to cause the cable to displace in a longitudinal direction. In a particular embodiment, the cable tensioning system can rotate about a balance point as a result of displacement of the cable in the longitudinal direction. In response to detecting rotation of the cable tensioning system, the gripping elements can apply corrective rotation relative to the cable such that rotational balance of the cable tensioning system is maintained. A balanced cable tensioning system can correlate with a generally constant tension within the cable.

Figure 2:
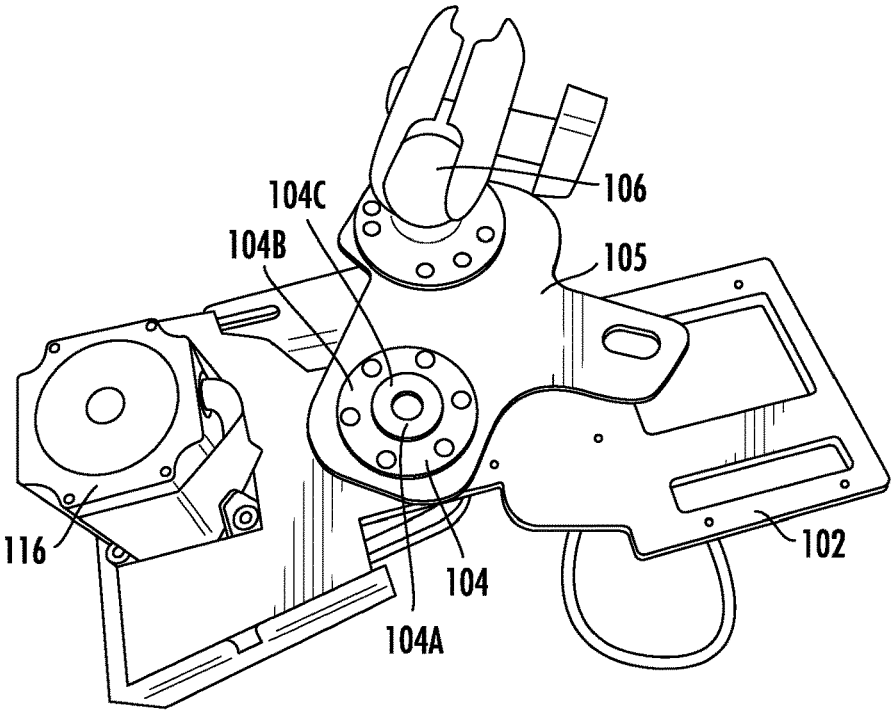
FIG. 2 is a rear perspective view of a cable tensioning system in accordance with an exemplary embodiment of the present disclosure.

Referring now to the drawings, FIG. 1 illustrates a front perspective view of a cable tensioning system 100 in accordance with an exemplary embodiment described herein. FIG. 2 illustrates a rear perspective view of the cable tensioning system 100 in accordance with an exemplary embodiment. The cable tensioning system 100 can generally include a body 102 defining a balance point 104. In an embodiment, the balance point 104 can correspond with a pivotal axis upon which the body 102 can pivot. In another embodiment, the balance point 104 can include a non-pivotal load determination method, such as using a tension gauge to measure relative tension within the cable tensioning system 100.

Figure 6:
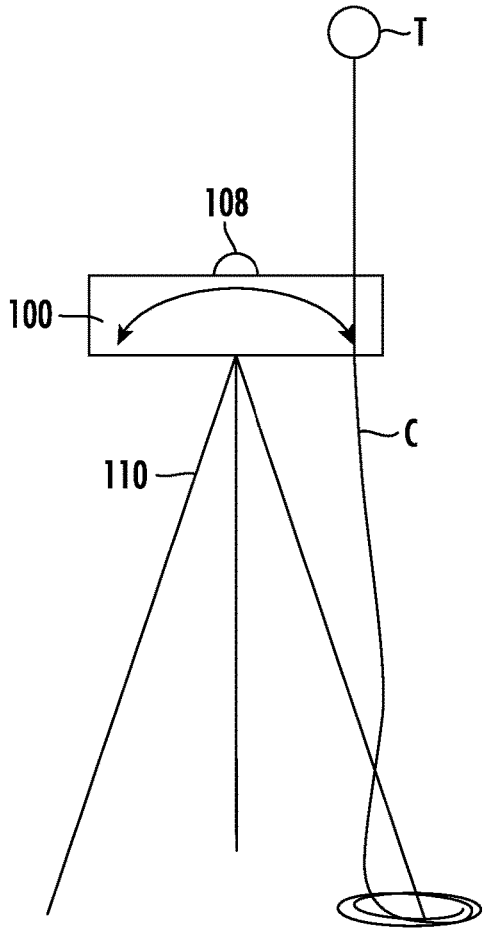
FIG. 6 is a schematic view of a cable tensioning system in use in accordance with an exemplary embodiment of the present disclosure.

A coupler 106 can be disposed at, or near, the balance point 104. The coupler 106 can be configured to couple the cable tensioning system 100 to a complementary coupler 108 (FIG. 6) of a support system 110, such as a tripod, an attachment mounted on a machine being serviced (e.g., inspected, repaired, and the like) or nearby equipment, and the like.

In an embodiment, the support system 110 can include a mount configured to receive the cable tensioning system 100. The mount can be attached to a machine being serviced. For example, the mount can be attached to a portion of a gas turbine engine undergoing servicing operations. In certain instances, the mount can be used to align the cable to be tensioned by the cable tensioning system at a desired position and/or angular orientation with respect to the gas turbine engine, the cable tensioning system 100, or both. That is, for example, the mount can reroute the cable in a desirable manner. The mount can include one or more adjustable features configured to selectively align the cable for tensioning operations. For instance, where the mount is required to be offset from an ingress point into the engine which might cause the cable to rub, one or more pulleys or other adjustment features of the mount can be selectively adjusted to offset the cable and prevent rubbing.

In an embodiment the coupler 106 can be coupled to the body 102 of the cable tensioning system 100 through the balance point 104. In an embodiment, the coupler 106 can be coupled to the body 102 through an intermediate plate 105. The exemplary balance point 104 depicted in FIG. 2 includes a bearing assembly, e.g., a ball bearing assembly, including a first (e.g., inner) hardware 104A, a second (e.g., outer) hardware 104B, and a race 104C disposed therebetween. The second hardware 104B is coupled to the intermediate plate 105 and the first hardware 104A is coupled to the body 102. The race 104C depicted in FIG. 2 includes a plurality of ball bearings disposed between the first and second hardware 104A and 104B. In other embodiments, the race 104C can be replaced by another bearing interface, such as a low friction intermediate bearing member (e.g., a PTFE sleeve) and the like. Alternatively, the race 104C may include roller bearings. It should be understood that other interfaces between the intermediate plate 105 and body 102 may be utilized in light of the disclosure contained herein. Moreover, in certain instances, the coupler 106 can be coupled to the body 102 through one or more other intermediary elements.

One or more of the cable tensioning systems 100 described herein may be portable and readily deployable at existing operational sites. The cable tensioning systems 100 may not require the use of a drum spool or other wind up instruments. Instead, the cable tensioning systems 100 may include one or more discrete components which can be integrated into existing workflows. For example, the cable tensioning system 100 can be introduced to an area where a machine is being operated on and deployed in said area for use in maintaining cable tension in one or more cables in the area.

Figure 3:
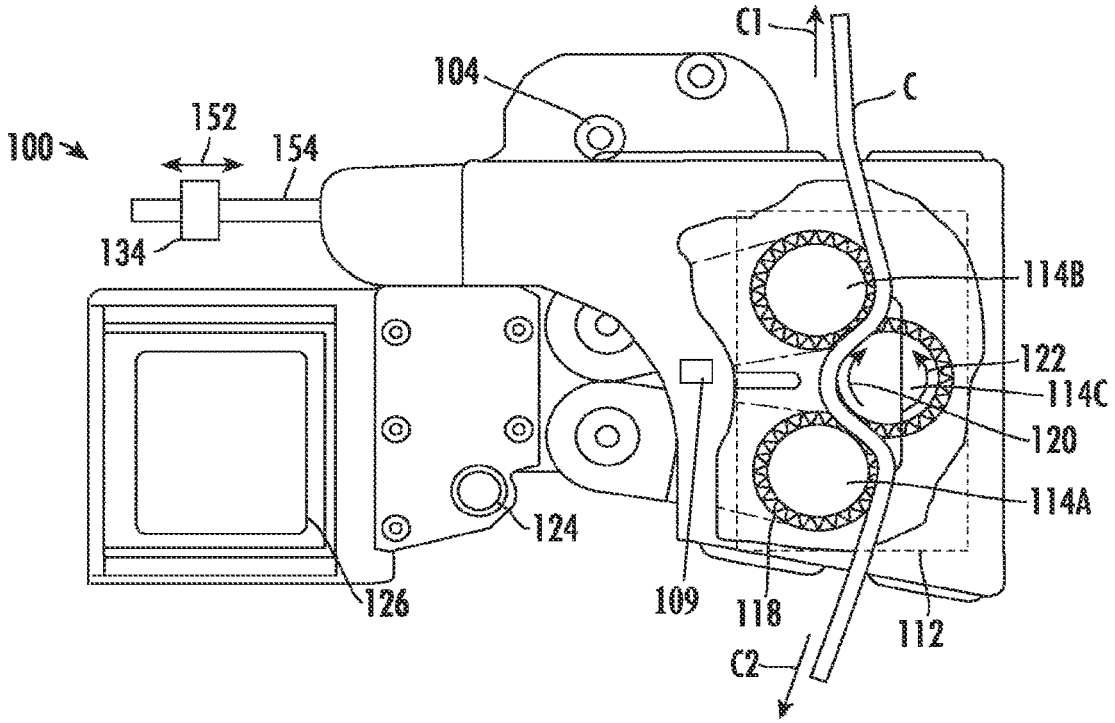
FIG. 3 is a partially cut-away view of a cable tensioning system in accordance with an exemplary embodiment of the present disclosure.

FIG. 3 illustrates a partially cut-away front view of the cable tensioning system 100. More particularly, a portion of a cover of the body 102 is shown cut a way to reveal an underlying cable receiving area 112. The cover of the body 102 may cover the cable receiving area 112 so as to mitigate exposure of pinch points. The cable receiving area 112 can include one or more gripping elements 114 configured to grip a cable C. In an embodiment, the one or more gripping elements 114 includes a plurality of gripping elements 114, such as at least two gripping elements 114, such as at least three gripping elements 114, such as at least four gripping elements 114, such as at least five gripping elements 114. In the illustrated embodiment, the cable receiving area 112 includes three gripping elements, including a first gripping element 114A, a second gripping element 114B, and a third gripping element 114C. The first and second gripping elements 114A and 114B may be passively arranged. That is, the first and second gripping elements 114A and 114B may not be driven. The third gripping element 114C can be active, e.g., driven. In an embodiment, the third gripping element 114C is driven by a motor 116 (FIG. 1). In a particular embodiment, the third gripping element 114C can be disposed between the first and second gripping elements 114A and 114B. More specifically, the third gripping element 114C can be disposed relative to the first and second gripping elements 114A and 114B such that the third gripping element 114C biases the cable C into both the first and second gripping element 114A and 114B. Biasing of the cable C can include introduction of force to the cable C, e.g., through rotation of one or more of the gripping elements 114. Other arrangements of the plurality of gripping elements 114 are contemplated without deviating from the scope of the disclosure.

At least one of the gripping elements 114 can include a grip surface 118. The grip surface 118 can include texture, spatial geometry, or the like configured to enhance grip with the cable C. By way of example, the texture can include knurling, castellations, bevels, teeth, tines, and the like. Exemplary spatial geometry can include circumferentially extending channels into which the cable C can be securely fitted. Pinched between the gripping elements 114, the cable C can be maintained at a relatively fixed position with respect to the cable tensioning system 100 when the gripping elements 114 are stationary. That is, the gripping elements 114 may be configured to maintain a portion of the cable C disposed within or adjacent to the cable tensioning system 100 at a relatively fixed position when the gripping elements 114 are stationary, i.e., not rotating. The gripping elements 114 may be movable, e.g., rotatable, so as to feed the cable C into and out of the cable receiving area 112. For instance, the gripping elements 114 may be rollers configured to rotate about one or more axis oriented, e.g., perpendicular to the longitudinal axis of the cable C. In certain instances, the motor 116 can rotate the third gripping element 114C in a direction corresponding with arrow 120 to feed out cable C in direction C1. In such a manner, tension within the cable C can be decreased. In other instances, the motor 116 can rotate the third gripping element 114C in a rotational direction corresponding with arrow 122 to reel in the cable C. In such a manner, tension within the cable C can be increased. The first and second gripping elements 114A and 114B can rotate passively as the cable C is drawn thereby.

The cable C extends from the cable receiving area 112 in two directions—an upstream direction C1 and a downstream direction C2. In the illustrated embodiment, the upstream direction C1 corresponds with a portion of the cable C under tension, e.g., interfacing with a tool at a working end thereof. The portion of the cable C under tension may correspond with a working end of the cable C where maintenance of cable tension in a preset tension range is desired. Meanwhile, the downstream direction C2 may correspond with excess cable C where tension requirements are not necessary. For instance, the downstream direction C2 may correspond with excess cable that is not currently being used, i.e., it is currently inactive but some or all of it may be later introduced into the upstream direction C1.

As slack is introduced to the cable C from the upstream direction C1, the third gripping element 114C of the cable tensioning system 100 can rotate in the direction corresponding with arrow 122. That is, the cable tensioning system 100 can take up the slack and dispose of excess cable C by passing the cable C in the downstream direction C2. Similarly, if excess tension is introduced to the cable C along the upstream direction C1, the third gripping element 114C of the cable tensioning system 100 can rotate in the direction corresponding with arrow 120. That is, the cable tensioning system 100 can feed slack into the upstream direction C1 of the cable C so as to reduce the tension therein. Accordingly, in one or more embodiments, the cable tensioning system 100 may be configured to maintain cable tension in the upstream direction C1 of the cable C within a desired range by controlling direction and/or speed of rotation of the gripping element 114C. Downstream tension monitoring and/or maintenance of the cable C may not be required in certain applications. However, in some applications downstream tension may be monitored and compensated for in a manner similar to that as described above. It should be understood that reference to upstream and downstream sides of the cable C may be inverted in other embodiments. For example, in some embodiments, maintaining tension in the cable C can include monitoring and maintaining tension of the downstream direction C2 of the cable C instead of, or in addition to, maintaining tension in the upstream direction C1 of the cable C.

A sensor 109 can be utilized to monitor the relative balance of the cable tensioning system 100. The sensor 109 can be disposed along, e.g., on, the cable tensioning system 100. The sensor 109 can be configured to sense changes to the balance of the body 102 about the balance point 104. By way of non-limiting example, the sensor 109 can include an accelerometer, an angular position detector, and the like. As the body 102 rotates about the balance point 104, the sensor 109 can detect relative angular displacement of the cable tensioning system 100. The sensor 109 can be in communication with a logic element configured to receive the sensed angular displacement of the body 102 and provide corrective instructions to maintain balance of the body 102 about the balance point 104 within a target range. The logic element can convert a voltage to signals (e.g., signals including information such as direction of rotation and velocity) that a stepper motor 116 can interpret in controlling the aforementioned gripping element(s) 114. In certain instances, the logic element can be part of the cable tension system 100, i.e., integral therewith. In other embodiment, the logic element can be part of a discrete component separate from the cable tensioning system 100. Corrective instructions provided by the logic element can be given to the motor 116 to rotate the third gripping element 114C as necessary. Feedback logic may be implemented to prevent sudden (jerking) application of forces and/or to dampen oscillating motion within the cable C. In an embodiment, maintaining attitude of the tensioner can be done using a feedback control, such as for example, linear control (P, PI, PD, PID), on-off control, phase-lag, phase-lead, phase-lead-lag, LQR, H2, Hinfinity, and the like. It should be understood that feedback control methodology is not intended to be limited to the above examples. An on/off button 124 can be utilized to energize the cable tensioning system 100. The on/off button 124 may include indication of the status of the cable tensioning system 100—i.e., on, off, leveled, actively controlling, and the like.

Figure 4:
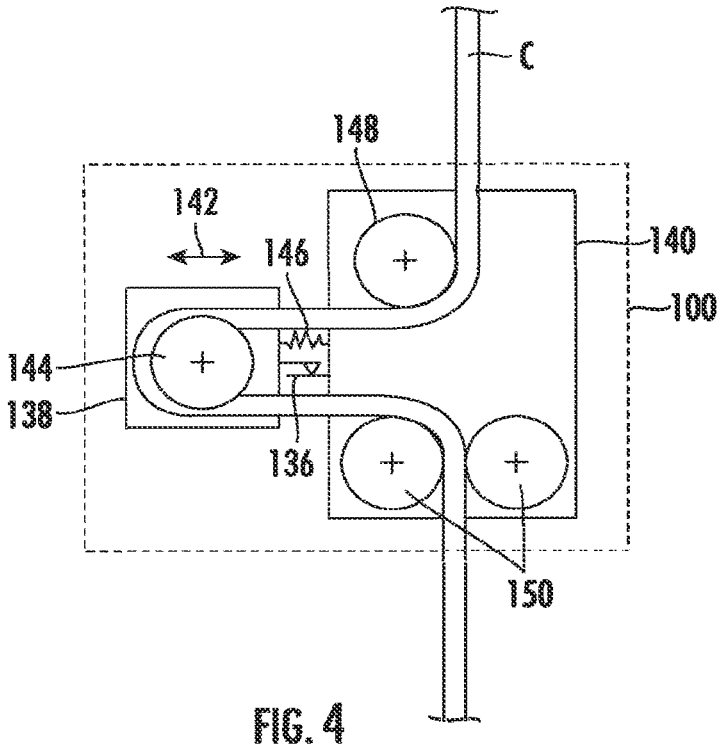
FIG. 4 is a front schematic view of a cable tensioning system in a configuration configured to receive a cable in accordance with an exemplary embodiment of the present disclosure.

FIG. 4 illustrates an embodiment of the cable tensioning system 100 in accordance with another embodiment. As illustrated, the cable receiving area 112 can have a different geometry as compared to the cable tensioning system 100 depicted in FIG. 3. The cable tensioning system 100 depicted in FIG. 4 can sense and control tension within the cable C utilizing, e.g., linear displacement and detection of said linear displacement. In particular, the embodiment illustrated in FIG. 4 can utilize a gauge, such as a displacement gauge 136, to measure tension within the cable C. In an embodiment, the displacement gauge 136 can include a linear potentiometer, a linear encoder, or the like, configured to measure tension in the cable C. The displacement gauge 136 can measure the tension in real-time. Using a control loop, the cable tensioning system 100, or a logic device in communication therewith, can compare the measured and target cable tensions and drive the gripping elements accordingly to maintain or achieve desired tension. Target tension can be user derived. For instance, the operator can adjust the target tension using a user interface (not illustrated) associated with the cable tensioning system 100.

A travelling element 138 can be displaceable relative to a fixed portion 140 of the cable tensioning system 100 in a direction along axis 142. An element such as an idler pulley 144 can permit the travelling element 138 to move relative to the fixed portion 140 with minimal drag, on the cable C. In certain instances, calibrated systems can control for the introduction of drag at one or more of the elements of the cable tensioning system, such as at the idler pulley 144, gripping elements 114, or the like. In an embodiment, a biasing element, such as a spring 146, can extend between and bias the fixed portion 140 and travelling element 138 relative to one another. In the depicted exemplary embodiment, the spring 146 can operate in compression so as to bias the fixed portion 140 and travelling element 138 apart from one another. Spring rate of the spring 146 is known and used in adjusting tension in the cable tensioning system in response to measured displacement changes by the displacement gauge 136. The cable tensioning system 100 may include upper and lower gripping elements, such as an idle gripping member 148 and lower gripping members 150. The particular arrangement of gripping members may be changed without deviating from the scope of this disclosure. For instance, the idle gripping member 148 can include a plurality of idle or driven gripping members and the lower gripping members 150 can include a single idle or driven gripping member. In the illustrated embodiment, at least one of the lower gripping members 150 are driven, e.g., by the aforementioned motor 116 (FIG. 2).

Cable tensioning systems 100 like the embodiment depicted in FIG. 4 can exhibit very low inertia, facilitating high-bandwidth performance. Cable tensioning systems 100 in accordance with embodiments described herein can maintain cable tension when faced with impulse disturbances, e.g., peaks of loading along the cable C, and reduce feedback loop overcompensation. That is, the cable tensioning system 100 can exhibit enhanced dampening of variations in cable tension caused by rapid changes of force (acceleration and jerk) along the cable C. In the embodiment illustrated in FIG. 4, the balance point of the cable tensioning system 100 can be defined at least in part by any one or more of the spring 146, the displacement gauge 136, the travelling element 138, a variable mount by which the travelling element 138 is connected to the fixed portion (not shown), and the like. For example, the balance point may refer to a balanced state where, e.g., the displacement gauge 136 is displaced by a desired amount indicative of proper, i.e., balanced, cable tension. This may include preload on the spring 146. Upon achieving such balance, no adjustment is required by the driven gripping members 150. That is, the driven gripping members 150 can impart no increased or decreased biasing to the cable C, e.g., as long as the displacement gauge 136 is maintained within its target range.

It should be understood that the embodiments illustrated in FIGS. 3 and 4 are exemplary only. Other arrangements of gripping members and idle pulleys, gauges, travelling elements, and the like are possible. In the embodiment illustrated in FIG. 3, the cable tensioning system 100 moves, e.g., rotates, to compensate for varying cable tensions, e.g., instantaneous variations in cable tension. That is, by way of example, the cable tensioning system 100 may utilize the moment of the cable tensioning system 100, or a portion thereof, to set a desired tension, or range of tensions, to be maintained in the cable C. In the embodiment illustrated in FIG. 4, the cable tensioning system 100 utilizes internal movement and/or sensing to compensate for varying cable tension. In this regard, the cable tensioning system 100 of FIG. 4 can remain stationary with respect to the environment. Accordingly, entry and exit points of the cable C to the cable tensioning system 100 can remain at fixed locations, fixed angles, and the like. Both the embodiments of FIG. 3 and FIG. 4 can utilize balance points as described herein, to set an ideal tension parameter of the cable C and affect displacement of one or more components of the cable tensioning system 100 (e.g., gripping elements 114) so as to maintain the ideal tension parameter or stay within a range corresponding with an acceptable deviation thereof.

Figure 5:
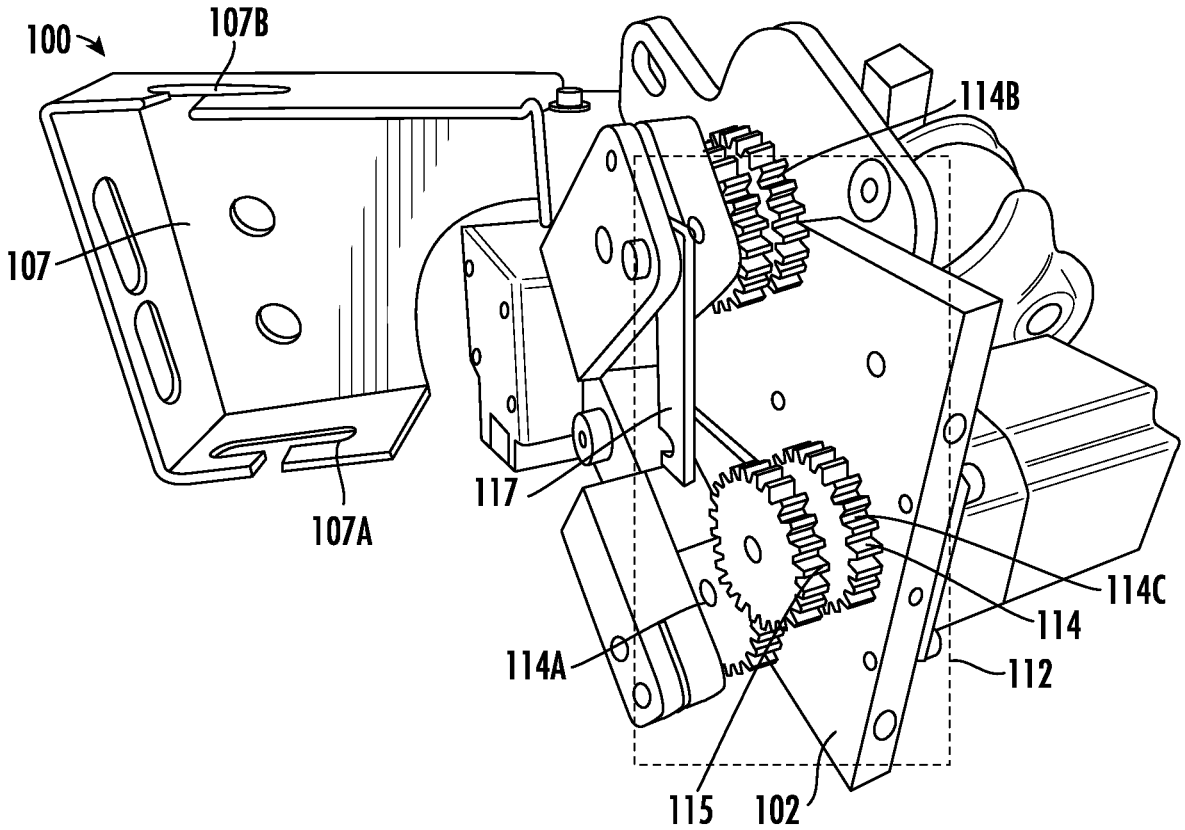
FIG. 5 is a schematic view of a cable tensioning system in accordance with another embodiment of the present disclosure.

FIG. 5 illustrates a perspective front view of the cable tensioning system 100 in accordance with an embodiment. The body 102 is shown in an open configuration, i.e., with a front face (cover) 107 in an open position to expose the cable receiving area 112. The front face 107 may include features, such as slots 107A and 107B that permit the cable to exit the cable receiving area 112 when the front face 107 is closed. The slots 107A and 107B may include entrances for receipt of the cable and extended slots through which the cable can move during tensioning operations. The slots 107A and 107B may be oriented such that the cable does not rub, or rubs minimally, against the front face 107. In the illustrated embodiment, the slots 107A and 107B define lengths that are parallel with the axis of rotation of the body 102 of the cable tensioning system 100 about the balance point 104. In such a manner, the cable minimally rubs, or avoids contacting, the body 102. This can reduce frictional interference with balance of the body 102, thereby increasing tensioning precision of the cable.

As illustrated in FIG. 5, at least one of the gripping elements 114 can include rollers defining channels 115 configured to receive the cable. The channels 115 can extend around a circumference of the gripping elements 114. In a particular embodiment, the channels 115 can extend around an entire circumference of the at least one gripping element 114. The operator can install the cable into the channels 115 and close the gripping elements 114 as described below prior to balancing the cable tensioning system 100.

In an embodiment, at least one of the gripping elements 114 can be movable between an engaged configuration (e.g., where the at least one gripping element 114 is engaged with the cable) and a disengaged configuration (e.g., where the at least one gripping element 114 is not engaged with the cable). In FIG. 3, the gripping elements 114 are depicted in the engaged configuration. Conversely, in FIG. 5, the first and second gripping elements 114A and 114B are depicted in the disengaged configuration. In a particular embodiment, the first and second gripping elements 114A and 114B can translate between engaged and disengaged configurations. In yet another particular embodiment, the first and second gripping elements 114A and 114B can translate and rotate/pivot between engaged and disengaged configurations.

An engagement mechanism 117, e.g., a clamp, can be used to selectively maintain the first and second gripping elements 114A and 114B in the engaged configuration. In the illustrated embodiment, the engagement mechanism 117 includes a selectively movable bar that extends between the first and second gripping elements 114A and 114B. The engagement mechanism 117 is shown detached from the first gripping element 114A (i.e., in the disengaged configuration), allowing the first and second gripping elements 114A and 114B to displace relative to one another for receipt of the cable. After installing the cable into the cable receiving area 112, the operator can selectively move the engagement mechanism 117 so as to secure the first and second gripping elements 114A and 114B together in the engaged configuration. The engagement mechanism 117 depicted in FIG. 5 is exemplary only. In other embodiments, the engagement mechanism 117 can include a motor configured to drive at least one of the first and second gripping elements 114A and 114B together, a spring-biasing element, a geared interface, another engagement mechanism, a linear or pivoting mechanism, or any combination thereof.

After the cable is installed into the cable receiving area 112, the front face 107 can be closed for the duration of tensioner operation. The closed front face 107 may prevent ingress of debris into the cable receiving area 112 and prevent accidental disengagement of the cable from the cable tensioning device 100. Moreover, the front face 107 can prevent accidental pinching of fingers and the like between the gripping elements 114.

The cable tensioning system 100 can be used to maintain a constant, or generally constant, tension within a cable C. Using active balance compensation, as defined by the ongoing sensing and correction of destabilizing (unbalancing) forces, the cable tensioning system 100 can be configured to maintain a desired tension within a tolerance less than 100 N, such as less than 50 N, such as less than 25 N, such as less than 20 N, such as less than 15 N, such as less than 10 N, such as less than 9 N, such as less than 8 N, such as less than 7 N, such as less than 6 N, such as less than 5 N, such as less than 4 N, such as less than 3 N, such as less than 2 N, such as less than 1 N. In certain instances, the cable tensioning system 100 can be configured to maintain desired tension within a tolerance less than 0.9 N, such as less than 0.8 N, such as less than 0.7 N, such as less than 0.6 N, such as less than 0.5 N, such as less than 0.4 N, such as less than 0.3 N, such as less than 0.2 N, such as less than 0.1 N, such as less than 0.05 N, such as less than 0.01 N. In certain instances, the cable tensioning system 100 can maintain the tension of the cable C within a desired tolerance while the cable C undergoes variable tensioning resulting, e.g., from moving the cable C or an implement on an end thereof. For example, referring to FIG. 6, in certain servicing operations a tool T is connected to a cable C routed through the cable receiving area 112. As the tool T is moved, for example, the tension in the cable C may change. For instance, as the tool T moves away from the cable receiving area 112, the tension in the cable C may increase. Conversely as the tool T moves toward the cable receiving area 112, the tension in the cable C may decrease. For tools T that rely on constant application of tension, this can be problematic. To counter this increase and decrease in tension, the cable tensioning system 100 can utilize its relative position with respect to its balance point 104 to maintain the cable C at a constant, or generally constant, tension, as measured between the cable tensioning system 100 and the tool T. Excess cable C can be wound, laid down, hung up, or otherwise stored for possible use.

Figure 7:
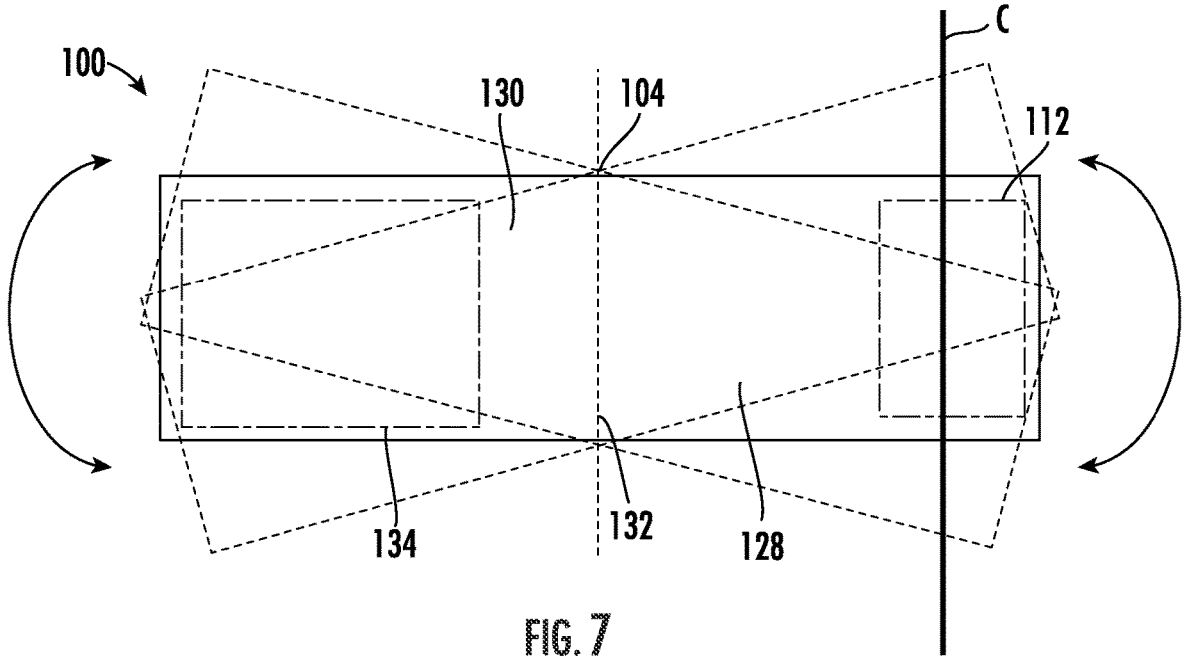
FIG. 7 is a schematic view of a cable tensioning system in accordance with an exemplary embodiment of the present disclosure.

FIG. 7 illustrates a simplified, schematic view of the cable tension system 100 undergoing rotational movement in response to changing load from the cable C. Left unchecked, the cable tension system 100 rotates in response to changing tension in the cable C. That is, if the gripping elements 114 in the cable receiving area 112 are fixedly secured to the cable C without being afforded an opportunity to correct for rotational movement caused by the cable C, the cable tension system 100 may rotate. For instance, as cable tension increases in the upward direction, the cable tension system 100 may rotate counter-clockwise (as depicted in FIG. 7). Similarly, as the cable tension decreases in the upward direction, the cable tension system 100 may rotate in the clockwise direction (as depicted in FIG. 7). To control (i.e., minimize) the cable tension system 100 from moving, and instead remain at the solid line (centered position), the motor 116 can adjust force provided to the aforementioned third gripping element 114C as described above.

The balance loading characteristics exhibited by the cable tension system 100 may be dependent on the geometry of the cable tension system 100 and/or particular counterweight and loading characteristics applied thereto. For instance, the embodiment depicted in FIG. 7 illustrates the cable tension system 100 divided into a first side 128 and a second side 130. The first and second sides 128 and 130 may be split by a centerline 132 that intersects the balance point 104. As illustrated, the cable receiving area is disposed on the first side 128 of the cable tension system 100 while a counterweight 134 is disposed on the second side 130 of the cable tension system 100. In a particular embodiment, the counterweight 134 and logic element 126 can be part of a same system. The cable tension system 100 can be adjusted (e.g., fine-tuned) by changing an attribute of the counterweight 134. For example, as the mass of the counterweight 134 is decreased or moved inboard, the upstream loading of the cable C (pulling the cable C upward in FIG. 7) necessary to rotate the cable tension system 100 decreases. Accordingly, when maintenance of relatively small tension force is required, the counterweight 134 may have a smaller mass. Conversely, when large tension forces are required, the counterweight 134 may have a larger mass. In another embodiment, the relative balance of the cable tension system 100 may be adjusted by moving the counterweight 134, the gripping elements 114, another element, or any combination thereof, relative to the centerline 132. For example, as the cable receiving area 112 is moved away from the centerline 132, the downward force of the counterweight 134 necessary to maintain balance may increase. By varying one or more aspects of the geometry of the cable tensioning system 100, the operator can select the appropriate tension to be applied to the cable. In this regard, the cable tensioning system 100 can be adjustable, i.e., configured to be adjusted based on desired tensions in each specific cable tensioning application.

Referring again to FIG. 3, in an embodiment the counterweight 134 can be adjustable. That is, for example, the counterweight 134 can be moveable within a range of positions in a direction corresponding with arrow 152 along a pathway 154. As the counterweight 134 is moved away from the cable receiving area 112, the tension in the cable C can be reduced. Conversely, as the counterweight 134 is moved toward the cable receiving area 112, tension in the cable C can be increased. This is an exemplary way of controlling target cable tension. It should be understood that the counterweight 134 and/or pathway 154 can be disposed at another location relative to the cable tensioning system 100. For example, the pathway 154 can alternatively be disposed near the cable receiving area 112. In this regard, tension may be increased by moving the counterweight 134 away from the cable receiving area 112 and decreased by moving the counterweight 134 toward the cable receiving area 112. In other exemplary embodiments, the counterweight 134 can have a different position, angular orientation, or the like.

Figure 8:
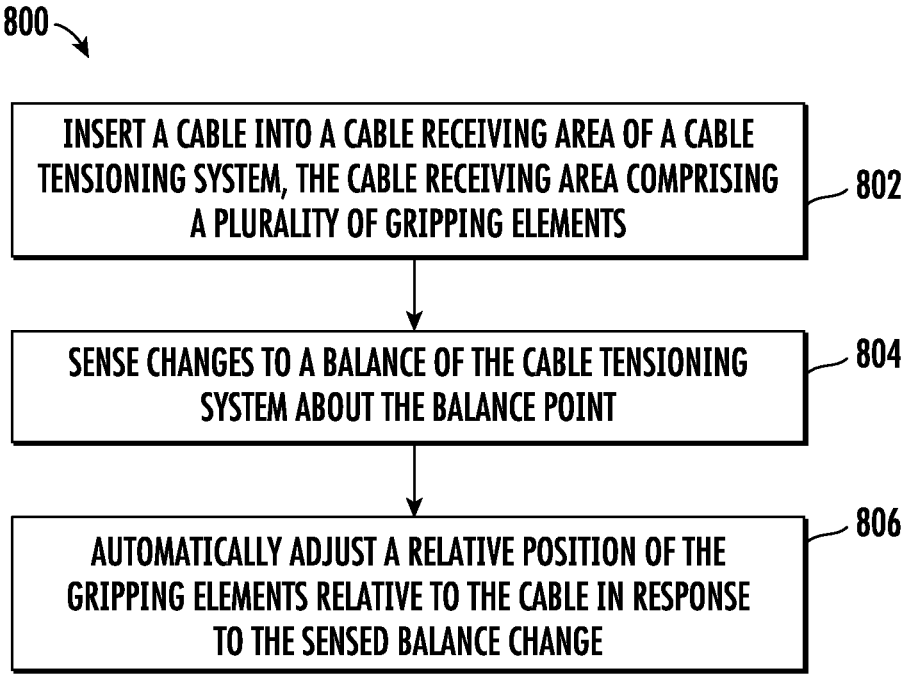
FIG. 8 is a flow chart of a method of maintaining tension in a cable in accordance with an exemplary embodiment of the present disclosure.

FIG. 8 illustrates a flowchart of a method 800 of maintaining tension of a cable. The method 800 includes a step 802 of inserting the cable into a cable receiving area of a cable tensioning system. The cable receiving area includes a plurality of gripping elements, such as those gripping elements 114 described herein. The cable can be inserted into the cable receiving area by translating the cable toward the cable receiving area in a transverse direction relative to a longitudinal axis thereof. That is, the cable does not need to be thread through the gripping elements. Accordingly, the cable tensioning system can be utilized in multiple environments and throughout various workflows where the longitudinal end of the cable is not readily available or necessary.

In certain instances, the method 800 further includes balancing the cable tensioning system about a balance point. This can include, for example, referencing the balance of the cable tensioning system, and setting a desired tension of the cable relative to the referenced balance of the cable tensioning system. In certain instances this may include automatic adjustment of the counterweight, spatial geometry of the cable tensioning system, rotational resistance at the balance point, a braking system, and the like. In an embodiment, balancing the cable tensioning system can occur after the step 802 of inserting the cable into the cable receiving area. In another embodiment, the balancing the cable tensioning system can occur before the step 802 of inserting the cable into the receiving area. In yet another embodiment, balancing the cable tensioning system and inserting the cable into the cable receiving area at step 802 can be performed at the same, or substantially same, time as one another.

The method 800 further includes a step 804 of sensing changes to a balance of the cable tensioning system about the balance point. Step 804 can be performed by an integrated sensor, an external sensor, or a combination thereof. The sensed changes to balance can then be analyzed by a logic device to determine corrective instructions to balance the cable tensioning device. The method 800 can further include a step 806 of automatically adjusting a relative position of the gripping elements relative to the cable in response to the sensed balance change, i.e., in response to the corrective instructions. The step 806 of automatically adjusting the relative position of the gripping elements can maintain the desired tension of the cable by pulling and releasing the cable as necessary.

Embodiments of the cable tensioning system described herein can utilize movement, e.g., rotational movement, of the cable tensioning system to balance and maintain tension within a cable being used with a tool during an operation. The cable tensioning system can be adjustable such that the tension within the cable can be controlled and set to prescribed load ratings and/or tolerance variables. That is, the operator can select a desired tension within the cable and/or a range of tolerance, i.e., outer limits of acceptable tension, in the cable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

Embodiment 1. A cable tensioning system comprising: a body defining a balance point; a cable receiving area having gripping elements configured to grip and bias a cable relative to the cable tensioning system; and a sensor configured to sense changes to a balance of the body about the balance point, wherein the cable tensioning system is configured to maintain the cable within a preset range of tensions.

Embodiment 2. The cable tensioning system of any one or more of the embodiments, further comprising a motor configured to control a rotational direction and velocity of the gripping elements.

Embodiment 3. The cable tensioning system of any one or more of the embodiments, further comprising a counterweight configured to offset the balance point the cable tensioning system.

Embodiment 4. The cable tensioning system of any one or more of the embodiments, wherein the gripping elements comprise a plurality of rollers, and wherein at least one of the rollers is driven by a motor.

Embodiment 5. The cable tensioning system of any one or more of the embodiments, wherein the balance point comprises a pivot axis about which the body is configured to pivot.

Embodiment 6. The cable tensioning system of any one or more of the embodiments, wherein the cable tensioning system further comprises a displacement gauge configured to measure relative displacement of a travelling element of the cable tensioning system in response to changing cable tension and adjust tension of the cable in response to measured displacement.

Embodiment 7. The cable tensioning system of any one or more of the embodiments, wherein the cable tensioning system is configured to be mounted at a location associated with a gas turbine engine.

Embodiment 8. A cable tensioning system comprising: a body defining a balance point; a plurality of gripping elements configured to grip and bias a cable relative to the cable tensioning system; an adjustable counterweight; a sensor configured to sense changing tension of the cable; a logic element configured to receive the sensed change in tension of the cable and provide corrective instructions to maintain the cable within a preset range of tensions; and a motor coupled to at least one of the gripping elements and configured to rotatably control the at least one gripping element in response to the corrective instructions from the logic element, wherein the preset range of tensions is adjustable using the adjustable counterweight.

Embodiment 9. The cable tensioning system of any one or more of the embodiments, wherein the plurality of gripping elements is adjustable to accommodate cables having different diameters.

Embodiment 10. The cable tensioning system of any one or more of the embodiments, further comprising a coupler coupled to the body, the coupler extending from the body and configured to be engaged with a complementary coupler of another object at a location associated with the cable.

Embodiment 11. The cable tensioning system of any one or more of the embodiments, wherein the cable tensioning system is configured to be coupled to a gas turbine engine using a mount configured to adjustably set at least one of a position and angle of the cable relative to the cable tensioning system Embodiment 12. The cable tensioning system of any one or more of the embodiments, wherein the balance point comprises a pivot axis about which the body is pivotally mounted.

Embodiment 13. A method of maintaining tension of a cable, the method comprising: inserting the cable into a cable receiving area of a cable tensioning system, the cable receiving area comprising a plurality of gripping elements; sensing changes to a balance of the cable tensioning system about a balance point of the cable tensioning system; and biasing the gripping elements relative to the cable in response to the sensed balance change.

Embodiment 14. The method of any one or more of the embodiments, wherein the balance point comprises a pivot axis about which the body is configured to pivot.

Embodiment 15. The method of any one or more of the embodiments, wherein the plurality of gripping elements comprises rollers, and wherein biasing the gripping elements comprises driving at least one of the rollers automatically with a motor.

Embodiment 16. The method of any one or more of the embodiments, wherein driving the at least one roller increases or decreases tension within the cable.

Embodiment 17. The method of any one or more of the embodiments, further comprising mounting the cable tensioning system at a location associated with a gas turbine engine.

Embodiment 18. The method of any one or more of the embodiments, wherein mounting the cable tensioning system is performed by coupling the cable tensioning system to a mount, the mount being coupled to the gas turbine engine.

Embodiment 19. The method of any one or more of the embodiments, further comprising calibrating the cable tensioning system by: referencing a relative balance of the cable tensioning system; and setting a desired tension of the cable relative to the referenced balance of the cable tensioning system.

Embodiment 20. The method of any one or more of the embodiments, further comprising adjusting the tension of the cable by adjusting a balance angle of the cable tensioning system about the balance point, changing an offset distance between the cable receiving area and the balance point, adjusting a counterweight of the cable tensioning system, adjusting a spring characteristic, or any combination thereof.

What is claimed is:

1. A cable tensioning system comprising:

a body defining a balance point;

wherein the body includes a cable receiving area having gripping elements configured to grip a cable relative to the cable tensioning system; and wherein the balance point comprises a pivot axis about which the body is configured to pivot;

a sensor configured to sense changes to a balance of the body about the balance point, wherein the cable tensioning system is configured to maintain the cable within a preset range of tensions.

2. The cable tensioning system of claim 1, further comprising a motor configured to control a rotational direction and velocity of the gripping elements.

3. The cable tensioning system of claim 1, further comprising a counterweight configured to adjust the balance point the cable tensioning system.

4. The cable tensioning system of claim 1, wherein the gripping elements comprise a plurality of rollers, and wherein at least one of the rollers is driven by a motor.

5. The cable tensioning system of claim 1, wherein the gripping elements include a first passive gripping element, a second passive gripping element, and a third driven gripping element, wherein a portion of the third driven gripping element and a portion of the cable that is in contact with the portion of the third driven gripping element are disposed between the first and second passive gripping elements.

6. A cable tensioning system comprising:

a body defining a balance point;

wherein the body includes a plurality of gripping elements configured to grip a cable relative to the cable tensioning system; and wherein the balance point comprises a pivot axis about which the body is configured to pivot;

a sensor configured to sense changing tension of the cable;

a logic element configured to receive the sensed change in tension of the cable and provide corrective instructions to maintain the cable within a preset range of tensions; and a motor coupled to at least one of the gripping elements and configured to rotatably control the at least one gripping element in response to the corrective instructions from the logic element, wherein the preset range of tensions is adjustable.

7. The cable tensioning system of claim 6, wherein the plurality of gripping elements are adjustable to accommodate cables having different diameters.

8. The cable tensioning system of claim 6, further comprising a coupler coupled to the body, the coupler extending from the body and configured to be engaged with a complementary coupler of another object at a location associated with the cable.

9. The cable tensioning system of claim 6, wherein the gripping elements include a first passive gripping element, a second passive gripping element, and a third driven gripping element, wherein a portion of the third driven gripping element and a portion of the cable that is in contact with the portion of the third driven gripping element are disposed between the first and second passive gripping elements.

10. A method of maintaining tension of a cable, the method comprising:

inserting the cable into a body including a cable receiving area of a cable tensioning system, the body defining a balance point, the balance point comprising a pivot axis about which the body is configured to pivot, the cable receiving area comprising a plurality of gripping elements;

sensing changes to a balance of the body of the cable tensioning system about the balance point of the body of the cable tensioning system; and biasing the gripping elements relative to the cable in response to the sensed balance change.

11. The method of claim 10, wherein the balance point of the body comprises a pivot axis about which the body is pivotally mounted.

12. The method of claim 10, wherein the plurality of gripping elements comprise rollers, and wherein biasing the gripping elements comprises driving at least one of the rollers automatically with a motor.

13. The method of claim 12, wherein driving the at least one roller increases or decreases tension within the cable.

14. The method of claim 10, further comprising calibrating the cable tensioning system by:

referencing a relative balance of the body of the cable tensioning system; and setting a desired tension of the cable relative to the referenced balance of the body of the cable tensioning system.

15. The method of claim 10, further comprising adjusting the tension of the cable by at least one of: adjusting a balance angle of the cable tensioning system about the balance point of the body, changing an offset distance between the cable receiving area and the balance point of the body, adjusting a counterweight of the cable tensioning system, adjusting a spring characteristic, or any combination thereof.

* * * * *